US008172628B2

(12) United States Patent
Yazaki et al.

(10) Patent No.: US 8,172,628 B2
(45) Date of Patent: May 8, 2012

(54) THROTTLE VALVE DRIVE MECHANISM OF OUTBOARD ENGINE UNIT

(75) Inventors: Makoto Yazaki, Wako (JP); Teruhiko Otsuki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 310 days.

(21) Appl. No.: 12/574,364

(22) Filed: Oct. 6, 2009

(65) Prior Publication Data

US 2010/0105262 A1 Apr. 29, 2010

(30) Foreign Application Priority Data

Oct. 23, 2008 (JP) ..... 2008-273367

(51) Int. Cl.
*B63H 21/21* (2006.01)

(52) U.S. Cl. ..... 440/87

(58) Field of Classification Search ..... 440/87
See application file for complete search history.

(56) References Cited

U.S. PATENT DOCUMENTS 1,843,272 A * 2/1932 Evinrude ..... 440/2
2,125,538 A * 8/1938 Boyce ..... 261/52
2,200,685 A * 5/1940 Anderson ..... 477/212

FOREIGN PATENT DOCUMENTS

JP 7-286559 A 10/1995
JP 07-293283 A 11/1995
JP 2004-162676 A 6/2004

OTHER PUBLICATIONS

Japanese Office Action dated Sep. 20, 2011, issued in corresponding Japanese Patent Application No. 2008-273367.

* cited by examiner

*Primary Examiner* — Stephen Avila
(74) *Attorney, Agent, or Firm* — Westerman, Hattori, Daniels & Adrian, LLP

(57) ABSTRACT

Pivot arm supported by a base is pivotable about an arm support shaft by being pulled via a throttle cable, and a throttle cam supported by the base via a cam support shaft and having a guide groove that has a guide section of the pivot arm movably therein. The arm support shaft and the cam support shaft are disposed in non-parallel relation to a valve shaft of the throttle valve and at such positions as not to overlap the throttle valve as viewed from a lateral side of the throttle valve drive mechanism.

4 Claims, 9 Drawing Sheets

THROTTLE VALVE DRIVE MECHANISM OF OUTBOARD ENGINE UNIT

FIELD OF THE INVENTION

The present invention relates to an improvement in throttle valve drive mechanisms of outboard engine units.

BACKGROUND OF THE INVENTION

Heretofore, there have been known throttle valve drive mechanisms provided in outboard engine units, in which a valve shaft of a throttle valve is driven via a throttle cable. One example of such throttle valve drive mechanisms is disclosed in Japanese Patent Application Laid-Open Publication No. HEI-07-286559 (JP H07-286559 A). FIG. 10 hereof illustrates a basic construction of the throttle valve drive mechanism disclosed in JP H07-286559 A. Operating link mechanism 200 for an engine provided on an outboard engine unit includes: a pulley 202 having throttle cables 201*a* and 201*b* wound thereon; a cam 203 provided on the outer periphery of the pulley 202; an accelerator 205 operable by being pushed by the cam 203; an accelerator rod 206 provided on the accelerator 205; and a throttle valve pivot shaft 207 connected to the rod 206. In the disclosed throttle valve drive mechanism, a pivot shaft 211 of the accelerator 205 for driving the rod 26, a pivot shaft 212 of the cam 203 and the throttle valve pivot shaft 207 are disposed in parallel to one another.

However, because the above-mentioned three shafts 211, 212 and 207 are disposed in parallel to one another and because the rod 206, throttle cables 201*a* and 201*b*, etc. are provided around the shafts 211, 212 and 207, the throttle valve drive mechanism may undesirably increase in size in a direction perpendicular to the shafts 211, 212 and 207. Thus, although there is a great demand for reducing a size of a section around the throttle valve as in most outboard engine units having great spatial limitations, the throttle valve drive mechanism disclosed in JP H07-286559 A would prevent reduction in size of the section around the throttle valve.

SUMMARY OF THE INVENTION

In view of the foregoing prior art problems, it is an object of the present invention to provide an improved throttle valve drive mechanism of an outboard engine unit which permits reduction in size of a section around the throttle valve.

In order to accomplish the aforementioned object, the present invention provides an improved throttle valve drive mechanism for driving a throttle valve provided in an air intake system of an outboard engine unit, which comprises: a pivot arm supported by a base via an arm support shaft in such a manner that the pivot arm is pivotable about the arm support shaft by being pulled via a throttle cable; and a throttle cam supported by the base via a cam support shaft and having a guide groove that has a guide section of the pivot arm fitted therein, the throttle cam being pivotable about the cam support shaft with a pivoting characteristic corresponding to a valve characteristic of the throttle valve. The arm support shaft and the cam support shaft are disposed in non-parallel relation to a valve shaft of the throttle valve and at such positions as not to overlap the throttle valve as viewed from a lateral side of the throttle valve drive mechanism.

In some of the conventionally-known counterparts, the valve shaft for the throttle valve are disposed to extend in the same direction as the cam support shaft for the throttle cam and arm support shaft for the pivot arm. For example, if the valve shaft, cam support shaft and arm support shaft are all disposed to extend vertically in generally parallel relation to one another, it means that the valve shaft, cam support shaft and arm support shaft are arranged at some horizontal intervals. In such a case, not only the accelerator rod extends horizontally from the valve shaft, but also the cam and arm extend from the cam support shaft and arm support shaft horizontally. Because these rod, cam and arm have considerable horizontal lengths, a considerable space is required in the horizontal direction, and thus, there is a possibility of the throttle valve drive mechanism increasing in size, in the horizontal direction, of a section of the mechanism near the throttle body. Such a horizontal size increase would undesirably lower a layout freedom of component parts disposed around the throttle valve drive mechanism.

In the present invention, on the other hand, the arm support shaft and the can support shaft are each disposed in non-parallel relation to the valve shaft, it is possible to prevent the throttle valve drive mechanism from increasing in size in a direction non-parallel to the valve shaft. Thus, the present invention can reduce the size of the throttle valve drive mechanism.

In addition, the arm support shaft and the can support shaft are each disposed at such a position as not to overlap the throttle valve as viewed from a lateral side of the throttle valve drive mechanism. Thus, the present invention can prevent the throttle valve drive mechanism from increasing in size in a horizontal direction non-parallel to the valve shaft.

Preferably, the valve shaft of the throttle valve is disposed to extend vertically while the arm support shaft and the cam support shaft are disposed to extend horizontally. If the valve shaft is disposed to extend vertically like this, a valve arm is disposed horizontally. Further, if the arm support shaft and the cam support shaft are disposed to extend horizontally, the pivot arm and the throttle cam are disposed vertically. Namely, because the valve shaft, arm support shaft and cam support are not arranged in one same direction, the present invention can reduce a size, in the horizontal direction, of a section of the mechanism around the throttle valve.

Preferably, the pivot arm and the throttle cam are disposed below the throttle valve. Thus, the pivot arm and the throttle cam do no overlap the throttle valve as viewed from a lateral side of the throttle valve drive mechanism. As a result, the present invention can prevent the throttle valve drive mechanism from increasing in size in the horizontal direction and can even further reduce the size, in the horizontal direction, of the section of the mechanism around the throttle valve.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
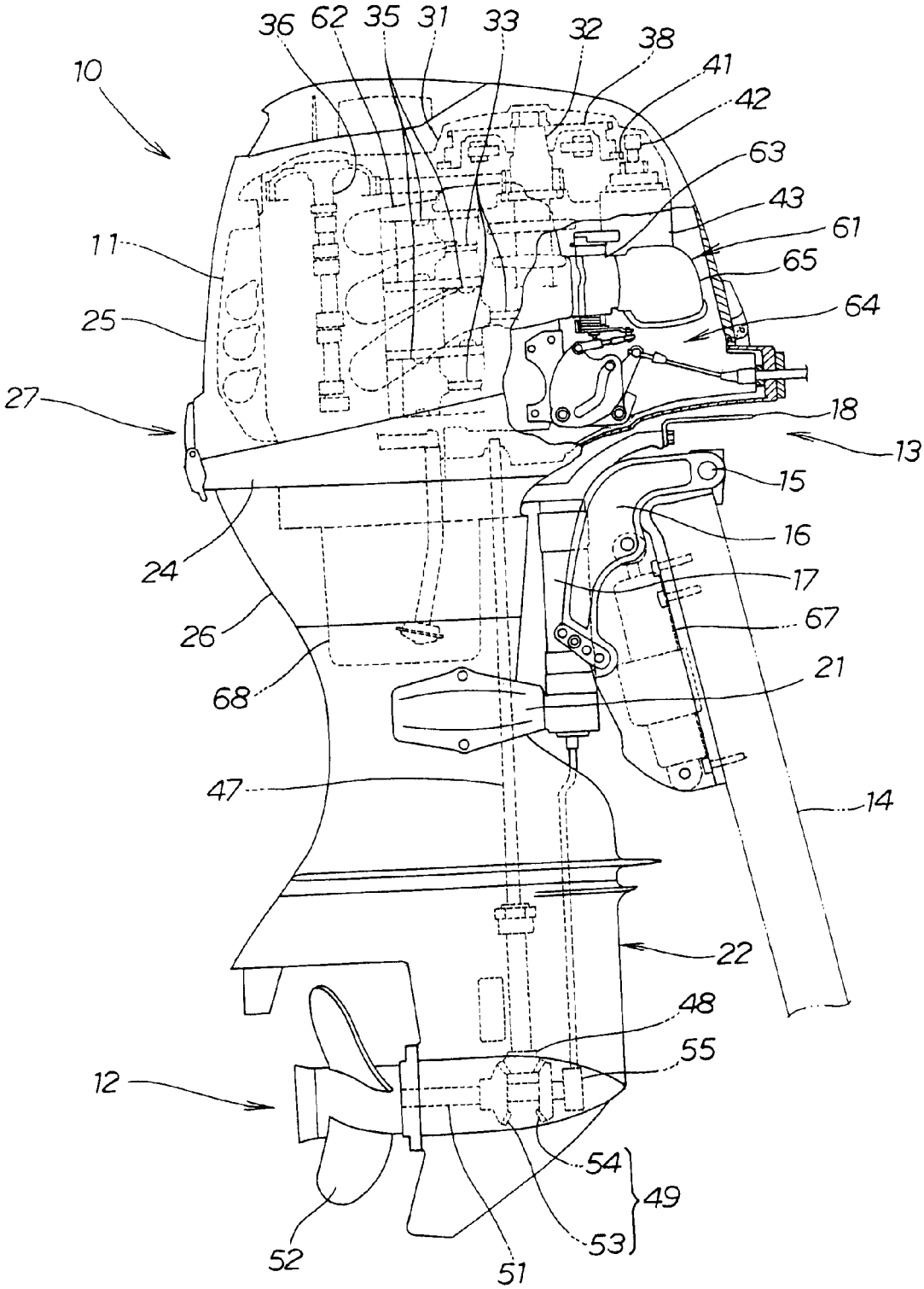
FIG. 1 is a side view showing an outboard engine unit provided with a throttle valve drive mechanism according to en embodiment of the present invention.

Reference is now made to FIG. 1 showing in side elevation an outboard engine unit provided with a throttle valve drive mechanism according to an embodiment of the present invention. The outboard engine unit 10 is a propulsion machine which internally includes an engine 11 that is a main component part of the unit 10, a propulsion device 12 driven by the engine 11 and a steering device 13, and which is attached to the outside of a body 14 of a boat.

The outboard engine unit 10 includes: a clamp bracket 16 detachably attached to a rear portion of the body 14 of the boat; a swivel bracket 17 vertically pivotably supported by the clamp bracket 16 via a horizontal shaft 15; a steering bracket 18 that is a component part constituting the steering device 13 and horizontally pivotably supported by the swivel bracket 17 via a vertical shaft; and a propulsion unit 22 supported by the steering bracket 18 via a mount 21.

The propulsion unit 22 includes a base section 24 supported by the steering bracket 18, the engine 11 mounted on the upper surface of the base section 24, and an upper case covering the outside of the engine 11. Further, a lower case 26 is disposed below the base section 24 to extend downwardly continuously from an upper case 25, so that the upper and lower cases 25 and 26 together constitute a casing 27.

In the instant embodiment, the engine 11 is a four-stroke, three-cylinder engine, which includes: a crankshaft 32 provided vertically in a cylinder block 31; a plurality of pistons 35 horizontally slidably connected to the vertical crankshaft 32 via a plurality of connecting rods 33; and a cam shaft 36 disposed horizontally outwardly of the crankshaft 32 for driving not-shown air intake and exhaust valves.

Flywheel 38 is provided on an upper end portion of the crankshaft 32, and a starter gear 41 is provided on the outer periphery of the flywheel 38. Starter motor 43 is connected with the crankshaft 32 via a pinion gear 42 engageable with the starter gear 41.

Drive shaft 47 is connected to a lower end portion of the vertical crankshaft 32 and extends vertically downward. Output gear 48 is provided on a lower end portion of the drive shaft 47, a propeller shaft 51 extending horizontally is connected to the output gear 48 via a bevel gear pair 49, a propeller 52 of the propulsion device 12, is provided on a distal end portion of the propeller shaft 51.

The bevel gear pair 49 comprises first and second bevel gears 53 and 54 disposed in opposed relation to each other and at right angles to the output gear 48. Rotation direction of the propeller 52 can be changed by the first or second bevel gear 53 and 54 being selectively connected to the propeller shaft 51 via a shift mechanism 55.

The following describe an air intake system 61 of the engine 11. The air intake system 61 of the engine 11, which is located closer to a reader of the figure, includes: an intake manifold 62 defining a passageway for supplying an air-fuel mixture to the engine 11; a throttle valve 63 disposed upstream of the intake manifold 62 for adjusting a flow rate of air; the throttle valve drive mechanism 64 for driving the throttle valve 63; and a carburetor 65 disposed upstream of the throttle valve 63 for generating an air-fuel mixture. Reference numeral 67 indicates a cushion unit, and 68 a lubricating oil tank. The following paragraphs describe details of the throttle valve drive mechanism 64

Figure 2:
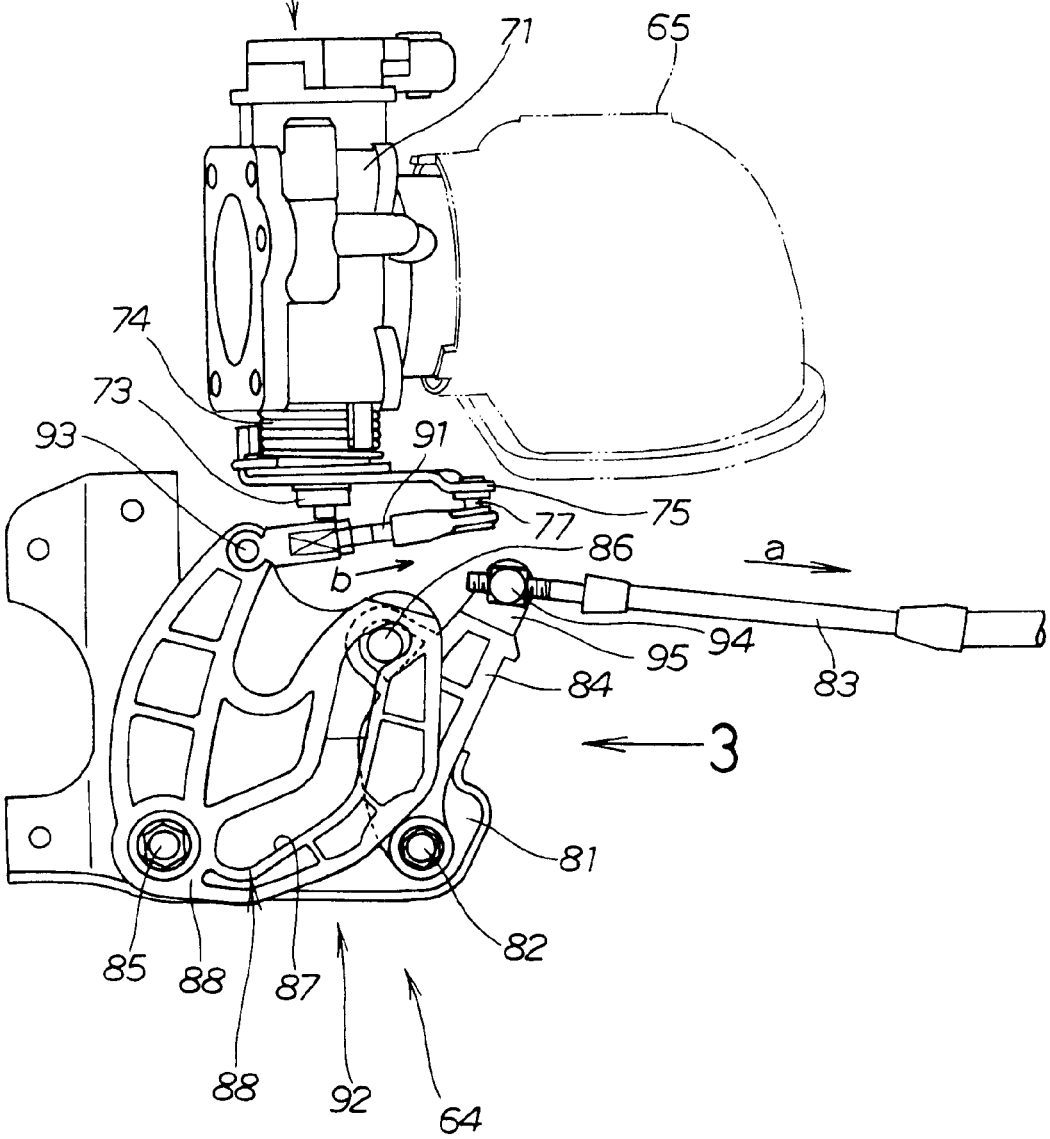
FIG. 2 is a side view of the throttle valve drive mechanism provided in the outboard engine unit of FIG. 1.
Figure 3:
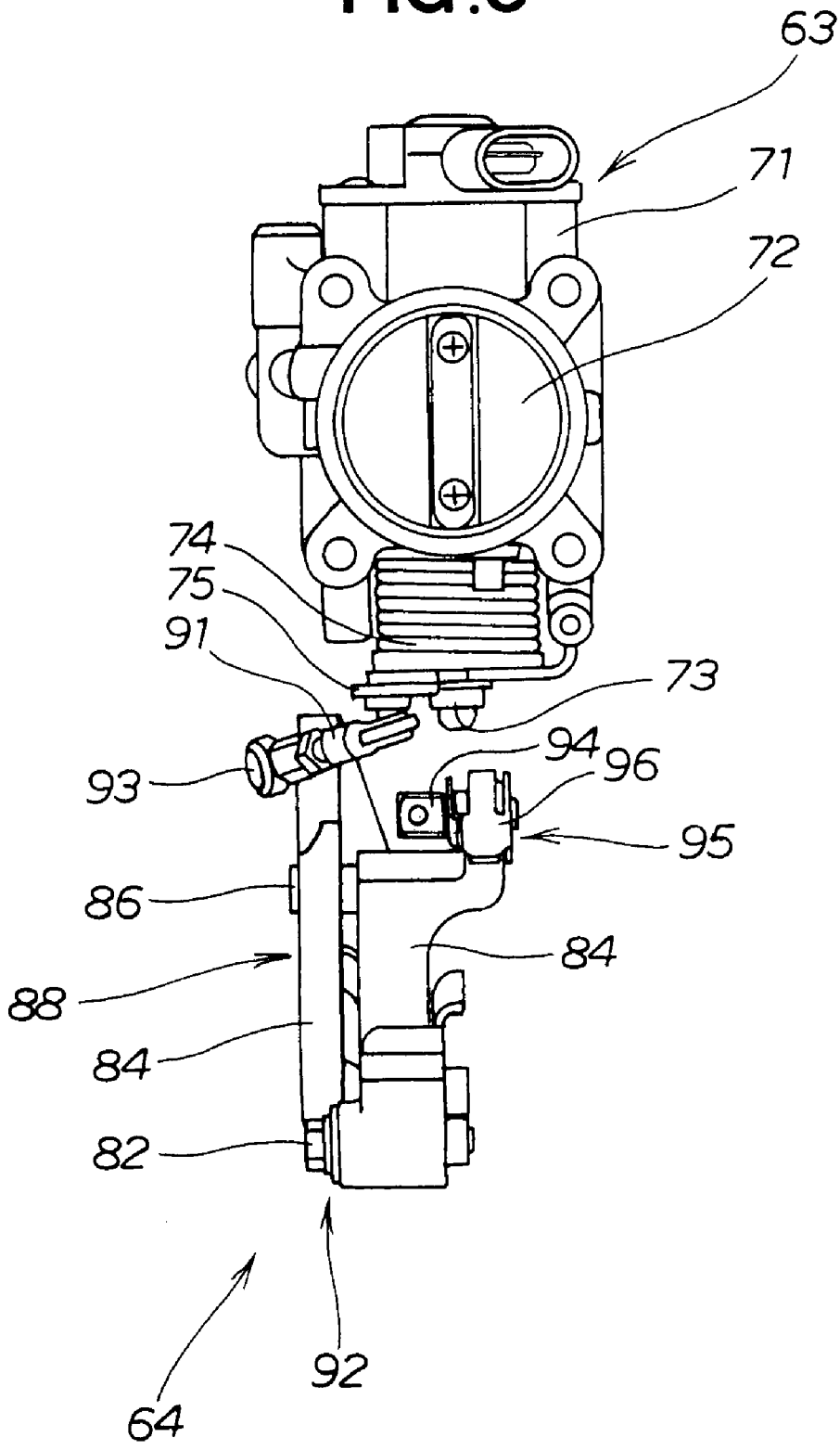
FIG. 3 is a view taken in the direction of arrow 3 of FIG. 2.
Figure 4:
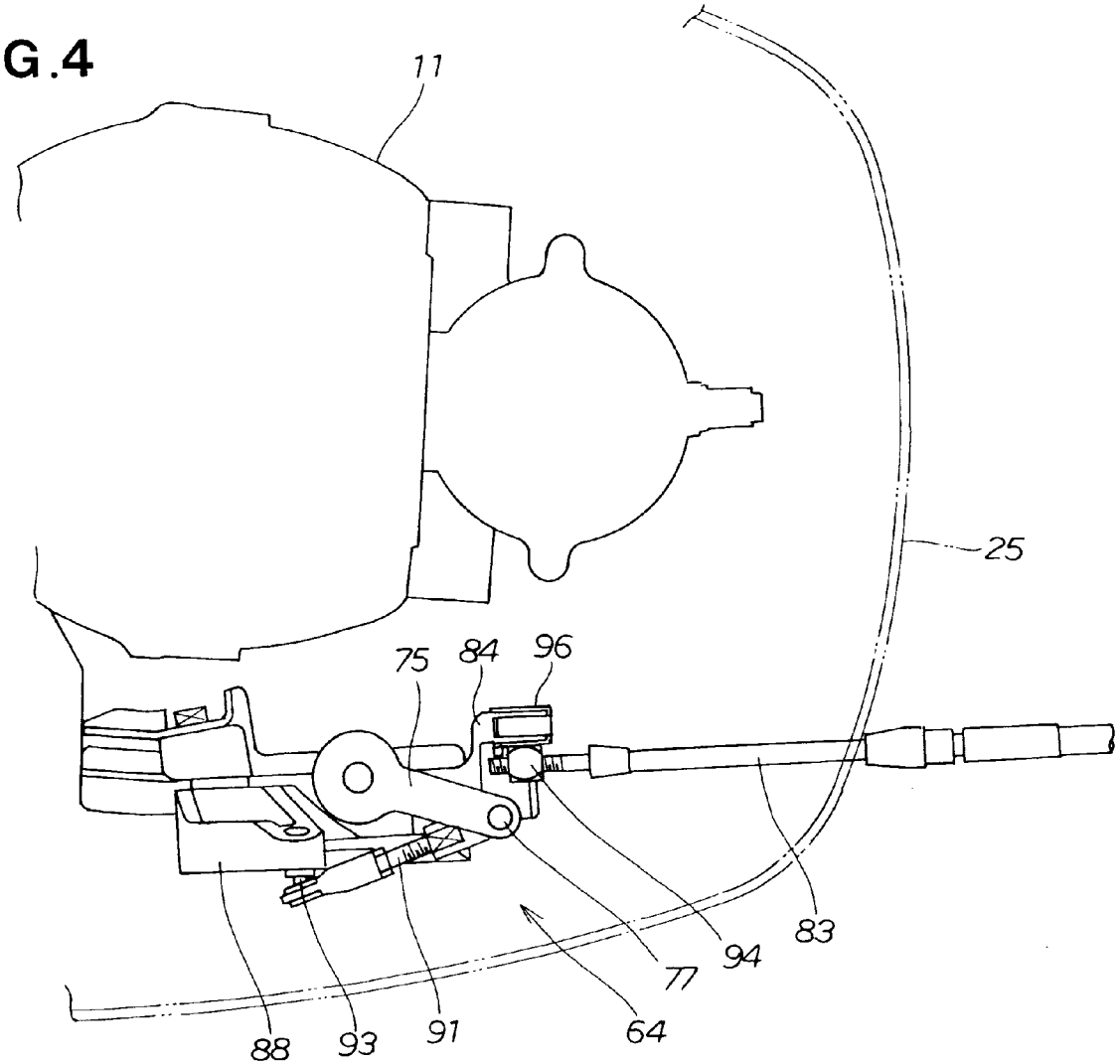
FIG. 4 is a top plan view of the throttle valve drive mechanism provided in the outboard engine unit of FIG. 1.

FIG. 2 is a side view of the throttle valve drive mechanism 64 provided in the outboard engine unit, FIG. 3 is a view take in a direction of arrow 3 of FIG. 2, and FIG. 4 is a plan view of the throttle valve drive mechanism 64.

The throttle valve 63 includes a throttle body 71, a valve body 72 disposed inside the throttle body 71 for adjusting an amount of air to be taken into the engine 11, and a valve shaft 73 formed integrally with the valve body 72 and functioning as a pivot shaft. Spring member 74 normally urges the valve body 72 in a closing direction of the valve body 72, and a valve arm 75 drives the throttle valve shaft 73.

The throttle valve drive mechanism 64 includes: a base 81 formed in a plate shape and attached to a side surface of the engine 11; a pivot arm 84 mounted on the base 81 and pivotable about the arm support shaft 82 by being pulled by a throttle cable 83; a throttle cam 88 pivotably supported by the base 81 via a cam support shaft 85, having a cam groove 87 that has fitted therein a guide section 86, provided on the pivot arm 84, in such a manner that the guide section 86 is movable along the edge of the cam groove 87, and exerting a pivoting characteristic corresponding to a valve characteristic, i.e. pivotable about the cam support shaft 85 with a pivoting characteristic corresponding to the valve characteristic of the throttle valve 63; and a connecting rod 91 extending from the throttle cam 88 to the throttle valve 63. Via an arm pivot 77, the connecting rod 91 is connected at its distal end portion to a distal end portion of the valve arm 75 extending from the valve shaft 73.

The throttle valve drive mechanism 64 further includes a valve opening degree adjustment mechanism 92 disposed between the throttle cable 83 and the throttle valve 63 for adjusting an opening degree characteristic of the throttle valve 63 that controls an operating speed of the engine 11.

The valve opening degree adjustment mechanism 92 comprises the base 81, the pivot arm 84 mounted on the base 81, and the throttle cam 88 having the guide groove 87 having the guide section 86 of the pivot arm 84 fitted therein and having a second pivot 93. Connecting rod 91 for driving the throttle valve 63 is connected to the second pivot 93.

The throttle cable 83 for driving the pivot arm 84 is connected to a distal end portion 95 of the pivot arm 84 via a pivot member 94. The pivot member 94, having one end portion of the throttle cable 83 fixed thereto, engages with the pivot arm 84, and a pivot member come-off preventing member 96 is attached to the pivot arm's distal end portion 95 for preventing the pivot member 94 from coming off, or being accidentally detached from, the pivot arm's distal end portion 95. Details of the pivot member come-off preventing member 96 will be discussed later.

In the instant embodiment, the arm support shaft 82 and the cam support shaft 85 are each disposed in non-parallel relation to the throttle valve shaft 73 of the throttle valve 63. Further, the arm support shaft 82 and the can support shaft 85 are disposed at such positions as not to overlap the throttle valve 63 as viewed from a lateral side of the throttle valve drive mechanism 64. Further, in the instant embodiment, the throttle valve shaft 73 is disposed to extend vertically, and the arm support shaft 82 and the can support shaft 85 are disposed to extend horizontally below the throttle valve 63.

In some of the conventionally-known counterparts, the valve shaft for the throttle valve are disposed to extend in the same direction as the cam support shaft for the throttle cam and arm support shaft for the pivot arm. For example, if the valve shaft, cam support shaft and arm support shaft are all disposed to extend vertically in generally parallel relation to one another, it means that the valve shaft, cam support shaft and arm support shaft are arranged at some horizontal intervals. In such a case, not only the accelerator rod extends horizontally from the valve shaft, but also the cam and arm extend from the cam support shaft and arm support shaft horizontally. Because these rod, cam and arm have considerable horizontal lengths, a considerable space is required in the horizontal direction, and thus, there is a possibility of the throttle valve drive mechanism increasing in size, in the horizontal direction, of a section of the mechanism near the throttle body. Such a horizontal size increase would undesirably lower a layout freedom of component parts disposed around the throttle valve drive mechanism.

In the instant embodiment, on the other hand, the arm support shaft 82 and the can support shaft 85 are each disposed in non-parallel relation to the valve shaft 73 of the throttle valve 63, it is possible to prevent the throttle valve drive mechanism 64 from increasing in size in the direction non-parallel to the valve shaft 73. Thus, it is possible to reduce the size of the throttle valve drive mechanism 64 which has great limitations in space for installing various component parts.

In addition, the arm support shaft 82 and cam support shaft 85 are each disposed at a position below the valve 63 in such a way as not to overlap the throttle valve 63 as viewed from a lateral side of the throttle valve drive mechanism 64. Thus, the instant embodiment can prevent the throttle valve drive mechanism 64 from increasing in size in the horizontal direction by the pivot arm 84 and the throttle cam 88 being disposed below the throttle valve 63, to thereby even further reduce the size of the throttle valve drive mechanism 64.

If a size of a section around the throttle value including the throttle valve drive mechanism 64 can be reduced in the aforementioned manner, not only the layout freedom of component parts in the outboard engine unit can be enhanced, but also the throttle valve drive mechanism 64 can be even further reduced in size in a horizontal direction non-parallel to the valve shaft 73.

With the instant embodiment, where the throttle valve shaft 73 is disposed to extend vertically while the arm support shaft 82 and can support shaft 85 are disposed to extend horizontally, there is no need to provide the throttle cam 88 and pivot arm 84 in the horizontal direction, so that the throttle valve drive mechanism 64 can be reduced in size in the horizontal direction.

Figure 5:
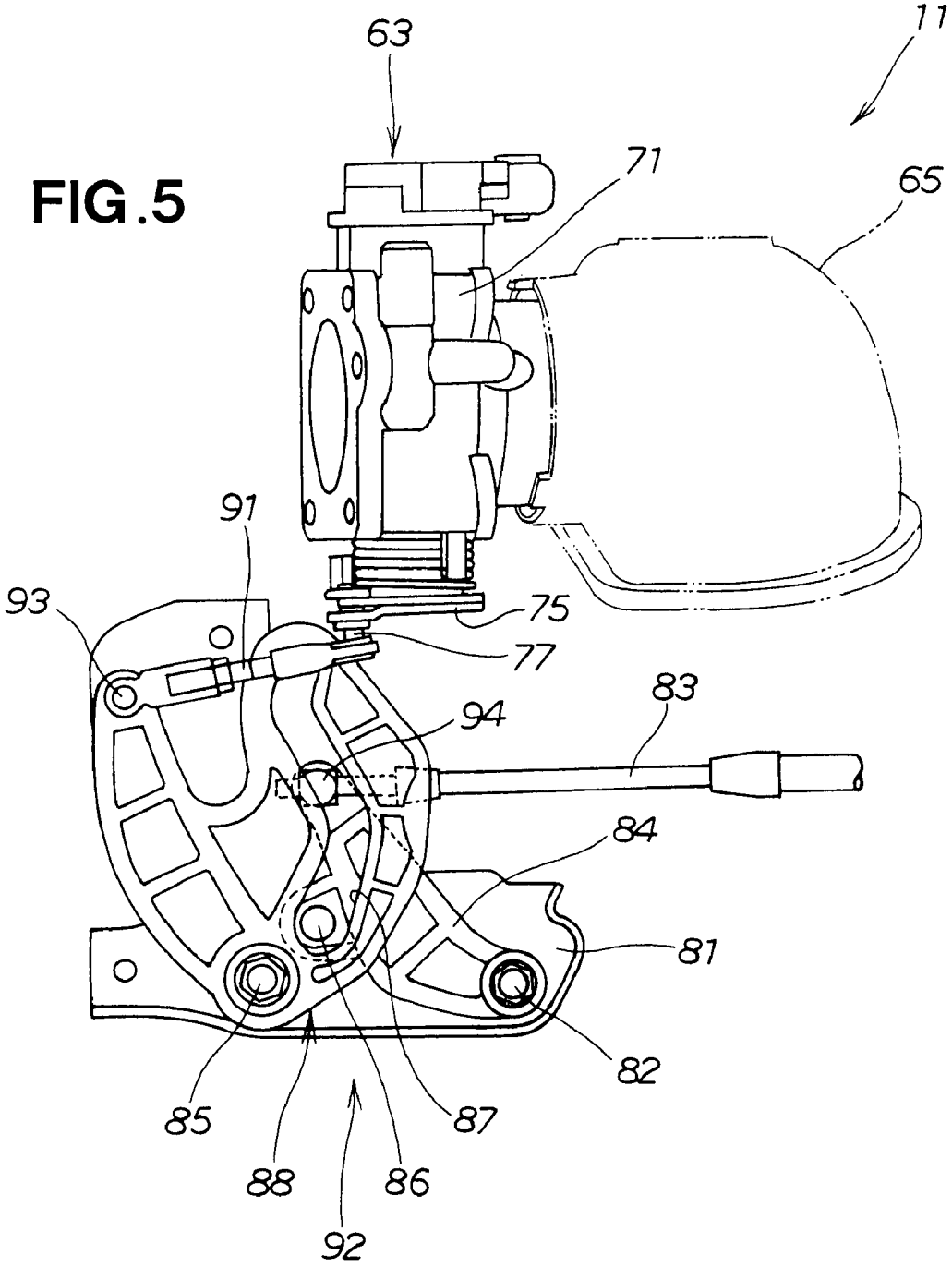
FIG. 5 is a view explanatory of behavior of the throttle valve drive mechanism provided in the outboard engine unit of FIG. 1.

FIG. 5 is a view explanatory of behavior of the throttle valve drive mechanism 64 provided in the outboard engine unit of FIG. 1, which shows the valve opening degree adjustment mechanism 92 when the engine 11 is in a stopped or idling state. In this state, the guide section 86 provided on the pivot arm 84 is located near the lower end of the cam groove 87.

Referring back to FIG. 2, there is shown the valve opening degree adjustment mechanism 92 when the engine 11 is in a throttle full-open state. In this state, the pivot arm 84 is pulled via the throttle cable 83 in a direction of arrow a in the figure to pivot clockwise about the arm support shaft 82, so that the throttle cam 88 pivots clockwise about the cam support shaft 85 via the guide section 86 and cam groove 87. Thus, the connecting rod 91 is moved in a direction of arrow b to pivot the valve shaft 73. When the engine 11 is in the throttle full-open state, the guide section 86 provided on the pivot arm 84 is located near the upper end of the cam groove 87.

Figure 6:
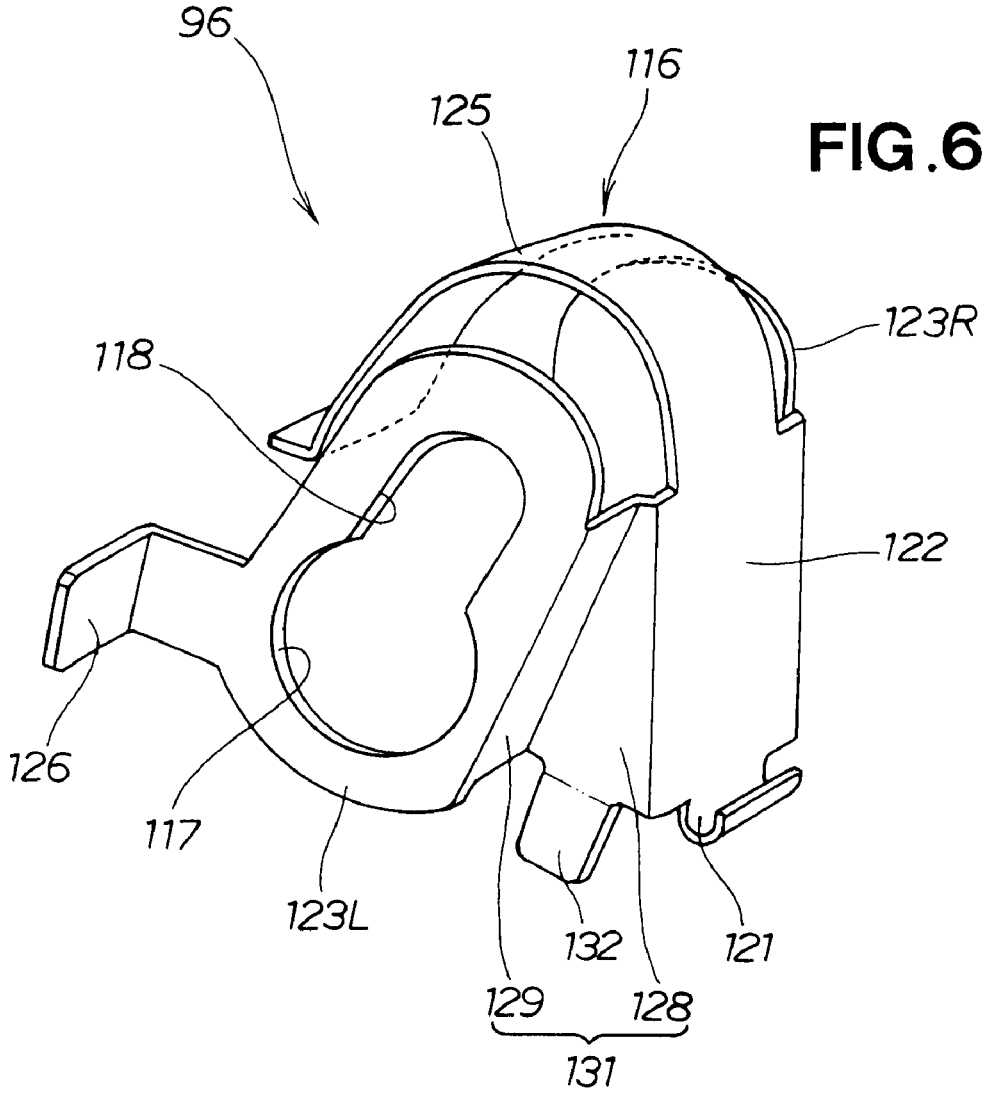
FIG. 6 is a perspective view of a pivot member come-off preventing member provided in the outboard engine unit of FIG. 1.
Figure 7:
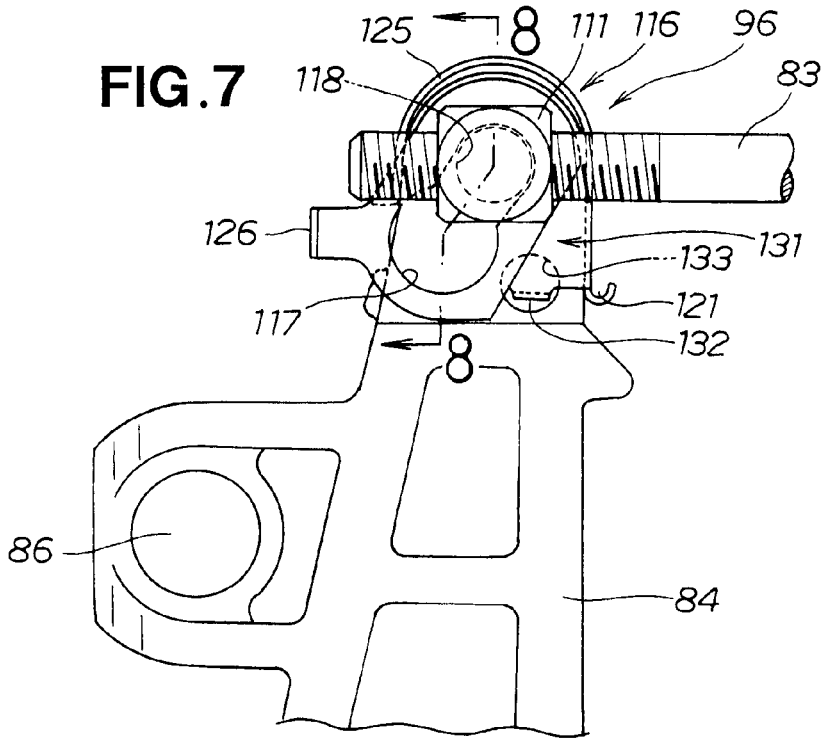
FIG. 7 is a side view of a pivot member come-off preventing member.
Figure 8:
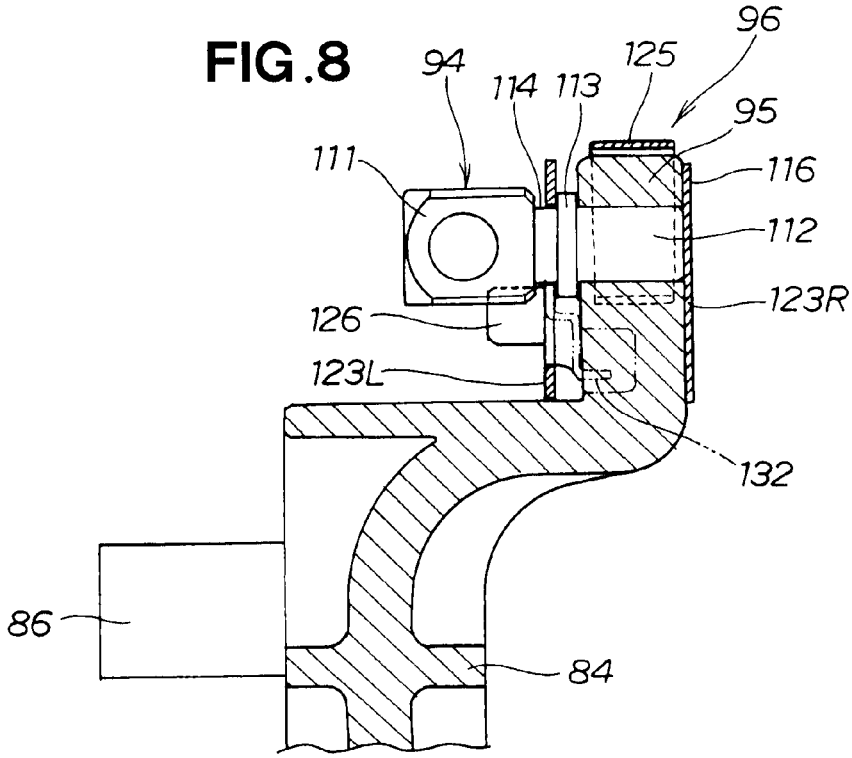
FIG. 8 is a sectional view taken along line 8-8 of FIG. 7.

The following describe details of the pivot member 94 and pivot member come-off preventing member 96. FIG. 6 is a perspective view of the pivot member come-off preventing member 96, FIG. 7 is a side view of the pivot member come-off preventing member 96, and FIG. 8 is a sectional view taken along the 8-8 line of FIG. 7.

The pivot member 94 has: a head section 111 engaging with one end portion of the throttle cable 83 to fix the cable 83 in place; a pin shaft section 112 extending from the head section 111; a flange section 113 provided between the head section 111 and the pin shaft section 112; and a neck section 114 provided between the head section 111 and the flange section 113.

The pivot member come-off preventing member 96 is a thin metal member, which has a cap section 116 capable of being put on the distal end portion 95 of the pivot arm 84, a large-diameter hole 117 formed in the cap section 116 and having a greater diameter than the flange section 113 of the pivot member 94, and an elongated hole 118 formed to extend continuously from the large-diameter hole 117.

As shown primarily in FIG. 6, the cap section 116 has: a rear surface portion 122 having a pivot axis portion 121 to permit pivoting movement of the pivot member come-off preventing member 96 at the time of attachment/detachment of the preventing member 96; left and right side plate portions 123L and 123R bent from the left and right side edges of the rear surface portion 122 to hold therebetween the left and right sides of the pivot arm 84; the large-diameter hole 117 formed in one of the left and right side plate portions 123L and 123R (left side plate portion 123L in the illustrated example); the elongated hole 118 formed continuously with the large-diameter hole 117, having an arcuate shape corresponding to part of an imaginary circle about the pivot axis portion 121 and fitting over the neck section 114 formed at one end portion of the pin shaft section 112, the elongated hole 118 having a width smaller than a diameter than the large-diameter hole 117; a resilient retaining portion 125 extending arcuately from the rear surface portion 122 for urging, engaging and retaining the distal end portion 95 of the pivot arm 84 when preventing member 96 is pivotally moved about the pivot axis portion 121 to be attached to the distal end portion 95; finger putting portions 126 provided on the left and right side plate portions 123L and 123R so that a human operator can put his or her fingers when attaching or detaching the pivot member come-off preventing member 96 to or from the distal end portion 95; a stepped portion 131 provided between the left side plate portion 123L and the rear surface portion 122 and having a vertical surface 128 and a horizontal surface 129; and a bent portion 132 to be bent into a recessed portion 133, formed in a side of the pivot arm 84, at the time of the attachment, to the pivot arm 84, of the preventing member 96.

The following further describe the construction of the pivot member come-off preventing member 96. The large-diameter hole 117 formed in a generally round shape in the left side plate portion 123L has a size or diameter large enough to permit insertion therethrough of the flange portion 113 of the pivot member 94, and the elongated hole 118 formed continuously with the large-diameter hole 117 has a size or width smaller than the diameter of the large-diameter hole 117 but large enough to permit fitting therein of the neck portion 114.

Namely, the pivot member come-off preventing member 96 is a member that prevents the pivot member 94 from coming off, or being accidentally detached from, the pivot arm 84 after the attachment, to the pivot arm 84, of the pivot member 94. For that purpose, the pivot member come-off preventing member 96 has the cap section 116 capable of being put on the distal end portion 95 of the pivot member 84 by being moved in a direction perpendicular to the axis of a pin hole section 135 formed in the pivot arm 84, the large-diameter hole 117 formed in the side plate portion 123L of the cap section 116, and the elongated hole 118 formed in the cap section 116 to extend continuously from the large-diameter hole 117 and corresponding in size to the neck section 114 so that it is engageable with the neck section 114. The above-mentioned pin hole section 135 is formed in the distal end portion of the pivot arm 84 pivotably supported by the base 81 via the arm support shaft 82, and the pin shaft section 112 is inserted in the pin hole section 135.

Figure 9A:
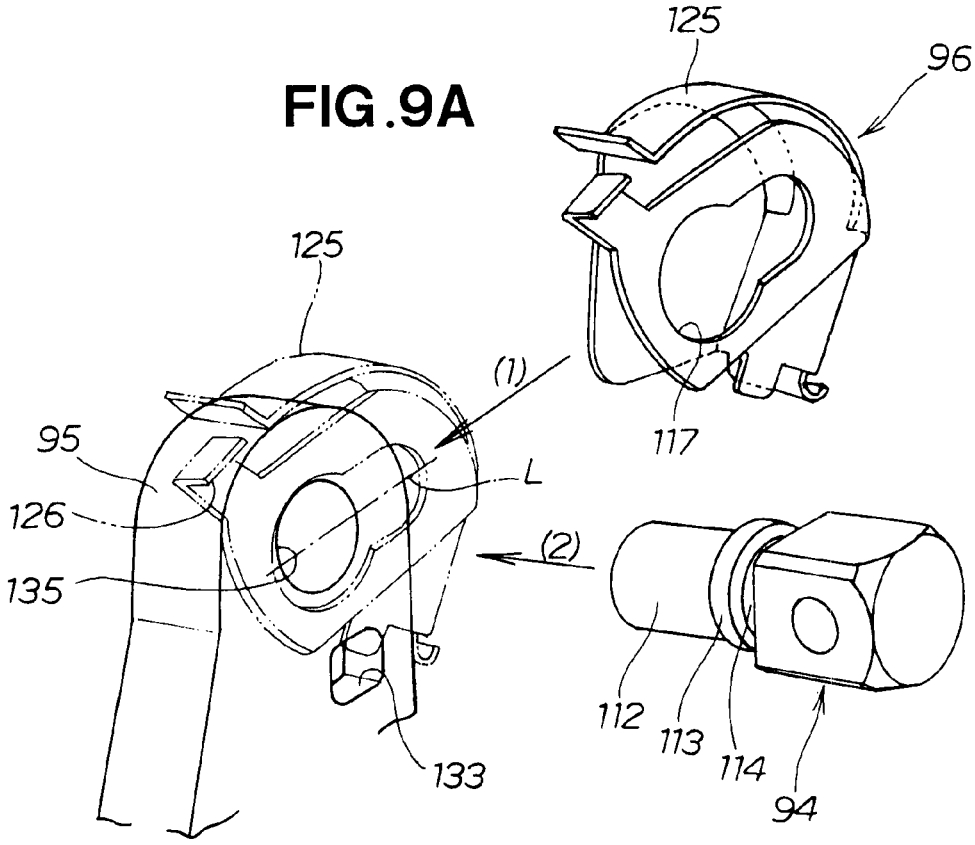
FIGS. 9A and 9B are views explanatory of an operational sequence for securely attaching a pivot member and pivot member come-off preventing member to a distal end portion of a pivot arm in the outboard engine unit of FIG. 1.
Figure 9B:
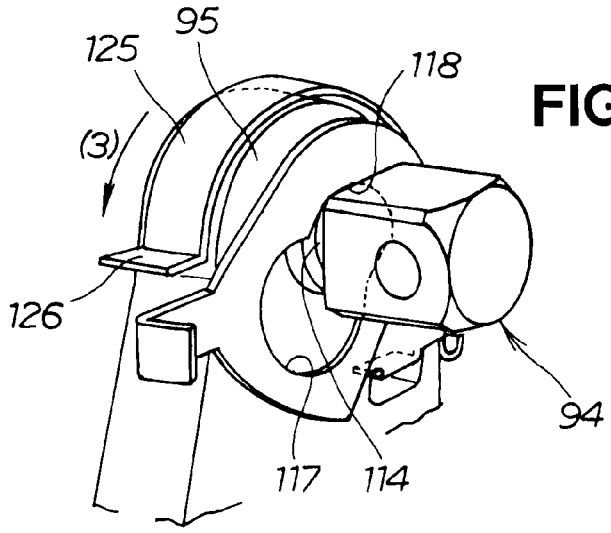
Figure 10:
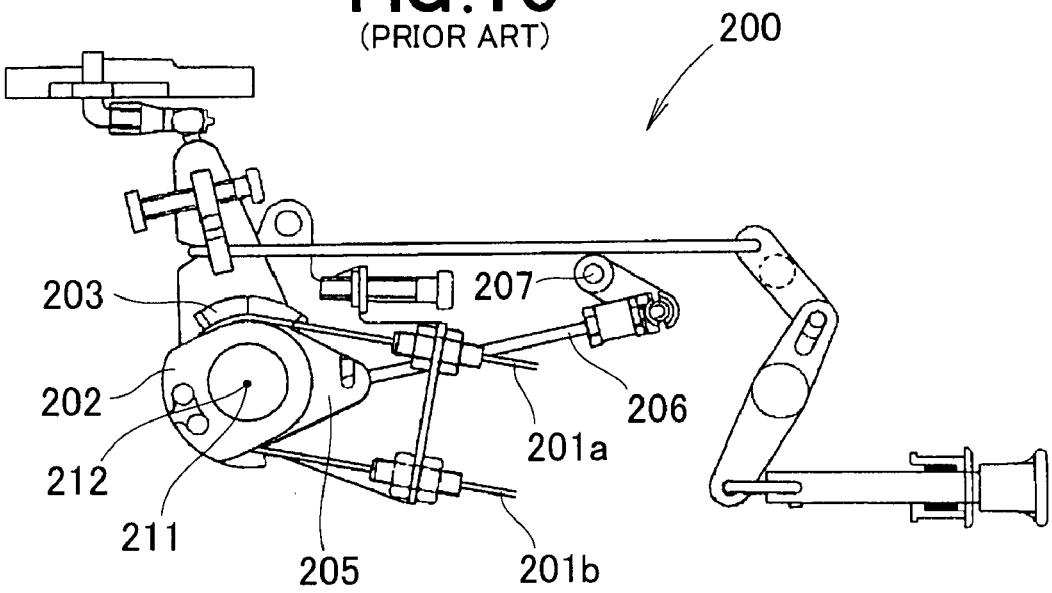
FIG.10 (PRIOR ART)
FIG. 10 is a schematic view illustrating a basic construction of a conventional throttle valve drive mechanism.

FIGS. 9A and 9B are views explanatory of an operational sequence for securely attaching the pivot member 94 and pivot member come-off preventing member 96 to the distal end portion of the pivot arm 84. First, as shown in FIG. 9A, the pivot member come-off preventing member 96 is inserted into the distal end portion 95 of the pivot arm 84 in such a manner that the large-diameter hole 117 of the pivot member come-off preventing member 96 positionally coincides with (i.e, axially aligns with) the pin hole section 135 of the pivot arm 84 as indicated by arrow (1).

Then, the pin shaft section 112 of the pivot member 94 having the one end portion of the throttle cable 83 (not shown in the figure) fixed thereto is inserted into the pin hole section 135 of the pivot arm 84 as indicated by arrow (2). After that, the bent portion 132 is bent into the recessed portion 133 of the pivot arm 84, in order to make more reliable the secure attachment, to the pivot arm 84, of the pivot member come-off preventing member 96.

Then, as shown in FIG. 9B, the pivot member come-off preventing member 96 is caused to pivot about the pivot axis portion 121 as indicated by arrow (3), so that the elongated hole 118 of the preventing member 96 engages the neck section 114 of the pivot member 94. In this manner, the operational sequence for attaching the pivot member 94 and pivot member come-off preventing member 96 is completed.

Namely, according to the aforementioned operational sequence, the pin shaft section 112 of the pivot member 94 is inserted into the pin hole section 135 formed in the distal end portion of the pivot arm 84 with the large-diameter hole 117, formed in the cap section 116 of the pivot member come-off preventing member 96, positioned in axial alignment with the pin hole section 135, and then the pivot member come-off preventing member 96 is put on the distal end portion 95 of the pivot arm 84 by the cap section 116 being moved, perpendicularly to the axis of the pin hole section 135, along the elongated hole 118 having the width corresponding to the diameter of the neck section 114 of the pivot member 94.

The pivot member come-off preventing member 96 constructed in the aforementioned manner is advantageous over a conventional come-off preventing member, for example, in the form of a cotter pin (or split pin) in that it can eliminate a trouble of inserting the cotter pin through a hole formed perpendicularly through the pin shaft section. In addition, it is possible to greatly enhance the operability in securely attaching the pivot member come-off preventing member 96 because the preventing member 96 can be fixedly attached to the pivot arm 84 by just the cap section 116 being moved to the distal end portion 95 of the pivot arm 84 after insertion, into the pin hole section 135 of the pivot arm 84, of the pin shaft section 112.

Furthermore, because there is no need to form a through-hole in the pin shaft section 112 for a cotter pin, it is possible to reduce the necessary axial length of the pin shaft section 112 as compared to the conventional example where the pivot member come-off preventing member is in the form of a cotter pin, so that there is no possibility of a necessary space undesirably increasing in the axial direction of the pin shaft section 112.

Further, because the cap section 116 is pivoted at indicated by arrow (3) after mounting, on the distal end portion 95 of the pivot arm 84, a centerline L (see FIG. 9A) passing the center of the elongated hole 118 and the center of the large-diameter hole 117 formed in the side plate section 123L is inclined with respect to a cap detaching orientation where the cap section 116 is detachable from the distal end portion 95 of the pivot arm 84. Therefore, as compared to a case where the centerline L of the cap section 116 is not inclined with respect to the cap detaching orientation of the cap section 116, the cap section 116 can be prevented from being accidentally detached from the distal end portion 95 with an increased reliability, so that the pivot arm 94 can be kept securely attached to the pivot arm 84 with an increased reliability.

In an alternative, the pivot member come-off preventing member 96 may be attached to the distal end portion of the pivot arm 84 with the above-mentioned centerline passing the centers of the elongated hole 118 and large-diameter hole 117 oriented to coincide with the cap detaching orientation instead of being inclined with respect to the cap detaching orientation. In this alternative too, the bent portion 132 is bent into the recessed portion 133 of the pivot arm 84 at the time of the attachment, to the pivot arm 84, of the preventing member 96, so that the preventing member 96 can be reliably attached to the pivot arm 84.

In addition, because the pivot member come-off preventing member 96 can be retained by the pivot arm 84 by the left and right side plate sections 123L and 123R sandwiching the pivot arm 84 in a left-right direction and the distal end portion 95 of the pivot arm 84 is normally urged by the resilient retaining portion 125, it is possible to prevent rattling movement etc. of the pivot member come-off preventing member 96.

Further, because the finger putting portions 126 are provided on the left and right side plate portions 123L and 123R of the pivot member come-off preventing member 96, the pivot member come-off preventing member 96 can be attached and detached with an even further enhanced operability. Note that the resilient retaining portion 125 and either or both of the finger putting portions 126 may be dispensed with.

The throttle cable 83 is provided for controlling the speed of the engine of the outboard engine unit, and the pivot member come-off preventing member 96 is used to fix the throttle cable 83 in the engine 11 of the output engine unit having great spatial limitations. Thus, the instant embodiment can eliminate the need for the cumbersome operation of inserting a cotter pin through the pivot member in an extremely limited space in the engine of the outboard engine unit as was done in the conventionally-known counterpart. Therefore, the pivot member come-off preventing member 96 employed in the instant embodiment can significantly enhance the operability in securely attaching the pivot member 94 and preventing member 96.

In an alternative, the throttle valve shaft 73 may be disposed to extend horizontally rather than vertically, and the arm support shaft 82 and the cam support shaft 85 may be disposed to extend vertically rather than horizontally. Furthermore, the pivot arm 84 and the throttle cam 88 may be disposed laterally or above the throttle valve 63 rather than below the throttle valve 63.

Whereas the throttle valve drive mechanism of the present invention has been described as applied to an outboard engine unit, it may also be applied to motor vehicles including two-wheeled motor vehicles (motorcycles), four-wheeled motor vehicles etc.

The present invention is well suited for application to outboard engine units where a throttle valve drive mechanism having a throttle cable is provided on a base.

What is claimed is:

1. A throttle valve drive mechanism for driving a throttle valve provided in an air intake system of an outboard engine unit, comprising:

a pivot arm supported by a base via an arm support shaft in such a manner that the pivot arm is pivotable about the arm support shaft by being pulled via a throttle cable; and a throttle cam supported by the base via a cam support shaft and having a guide groove that has a guide section of the pivot arm fitted therein, the throttle cam being pivotable about the cam support shaft with a pivoting characteristic corresponding to a valve characteristic of the throttle valve, wherein the arm support shaft and the cam support shaft are disposed in non-parallel relation to a valve shaft of the throttle valve and at such positions as not to overlap the throttle valve as viewed from a lateral side of the throttle valve drive mechanism, and wherein the valve shaft of the throttle valve is disposed to extend one of generally vertically or generally horizontally while the arm support shaft and the cam support shaft are disposed to extend another of generally vertically or generally horizontally.

2. A throttle valve drive mechanism for driving a throttle valve provided in an air intake system of an outboard engine unit, comprising:

a pivot arm supported by a base via an arm support shaft in such a manner that the pivot arm is pivotable about the arm support shaft by being pulled via a throttle cable; and a throttle cam supported by the base via a cam support shaft and having a guide groove that has a guide section of the pivot arm fitted therein, the throttle cam being pivotable about the cam support shaft with a pivoting characteristic corresponding to a valve characteristic of the throttle valve, wherein the arm support shaft and the cam support shaft are disposed in non-parallel relation to a valve shaft of the throttle valve and at such positions as not to overlap the throttle valve as viewed from a lateral side of the throttle valve drive mechanism, and wherein the valve shaft of the throttle valve is disposed to extend vertically while the arm support shaft and the cam support shaft are disposed to extend horizontally.

3. The throttle valve drive mechanism of claim 1, wherein the pivot arm and the throttle cam are disposed below the throttle valve.

4. The throttle valve drive mechanism of claim 1, wherein the valve shaft of the throttle valve is disposed to extend horizontally while the arm support shaft and the cam support shaft are disposed to extend vertically.

* * * * *